US006378981B1

(12) United States Patent
Wenzel et al.

(10) Patent No.: US 6,378,981 B1
(45) Date of Patent: Apr. 30, 2002

(54) SURFACTANT FOR INKJET SERVICE STATION WIPER FLUID

(75) Inventors: Donald E Wenzel, Albany; Jules G. Moritz, III; Paul F. Reboa, both of Corvallis, all of OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/552,133

(22) Filed: Apr. 19, 2000

(51) Int. Cl.[7] ..... B41J 2/165
(52) U.S. Cl. ..... 347/28; 347/33
(58) Field of Search ..... 347/28, 33; 252/117–118; 134/36, 42; 510/170, 421

(56) References Cited

U.S. PATENT DOCUMENTS 5,380,452 A * 1/1995 Blanvalet et al. ..... 252/117
5,500,659 A * 3/1996 Curran, Jr. et al. ..... 347/28
5,706,038 A 1/1998 Jackson et al. ..... 347/33
5,786,830 A 7/1998 Su et al. ..... 347/33
5,825,380 A * 10/1998 Ichizawa et al. ..... 347/28
5,825,391 A * 10/1998 Yang ..... 347/106
5,905,514 A 5/1999 Rhoads et al. ..... 347/33
5,907,335 A 5/1999 Johnson et al. ..... 347/33
5,914,734 A 6/1999 Rotering et al. ..... 347/33
5,929,007 A * 7/1999 Feng ..... 510/197
5,956,053 A 9/1999 Michael ..... 347/33
5,969,731 A 10/1999 Michael et al. ..... 347/33
5,980,018 A 11/1999 Taylor et al. ..... 347/31

* cited by examiner

*Primary Examiner*—Nancy Le
*Assistant Examiner*—Shih-Wen Hsieh
(74) *Attorney, Agent, or Firm*—W. Bradley Haymond

(57) ABSTRACT

A service station wiper fluid in an inkjet ink printing system, which in addition to the servicing fluid, also has a surfactant which improves the surface energy consistency of the nozzle plate, thus stabilizing the drop directionality of the ink from inkjet nozzle to the print media.

6 Claims, No Drawings

SURFACTANT FOR INKJET SERVICE STATION WIPER FLUID

FIELD OF INVENTION

The present invention relates to a service station wiper fluid in an inkjet ink printing system, which in addition to a servicing solvent, also has a surfactant which together with the solvent will be called the servicing fluid in this invention. The servicing fluid improves the consistent wetability of the nozzle plate, thus stabilizing the drop directionality of the ink from inkjet nozzle to the print media.

BACKGROUND OF INVENTION

The use of inkjet printing systems has grown dramatically in recent years. This growth may be attributed to substantial improvements in print resolution and overall print quality coupled with appreciable reduction in cost. Today's inkjet printers offer acceptable print quality for many commercial, business, and household applications at costs fully an order of magnitude lower than comparable products available just a few years ago. Notwithstanding their recent success, intensive research and development efforts continue toward improving inkjet print quality, while further lowering cost to the consumer.

An inkjet image is formed when a precise pattern of dots is ejected from a drop-generating device known as a "printhead" onto a printing medium. The typical inkjet printhead has an array of precisely formed nozzles located on a nozzle plate and attached to an inkjet printhead substrate. The substrate incorporates an array of firing chambers that receive liquid ink (colorants dissolved or dispersed in a solvent) through fluid communication with one or more ink reservoirs. Each chamber has a thin-film resistor, known as a "firing resistor," located opposite the nozzle so ink can collect between the firing resistor and the nozzle. In particular, each resistor element, which is typically a pad of a resistive material, measures about 35 $\mu$m×35 $\mu$m. The printhead is held and protected by an outer packaging referred to as a print cartridge, i.e., inkjet pen.

Upon energizing of a particular resistor element, a droplet of ink is expelled through the nozzle toward the print medium, whether paper, transparent film or the like. The firing of ink droplets is typically under the control of a microprocessor, the signals of which are conveyed by electrical traces to the resistor elements, thereby forming alphanumeric and other characters on the print medium.

Inkjet printers generally have a printhead service station to which an inkjet printhead is moved by the carriage, and a cap which sealingly contacts the printhead is generally located at the service station. At the service station, the printhead (or multiple heads if such are used) are occasionally cleaned and, if necessary, primed with ink. For use in this cleaning function, wipers are located at the service station. The service station can include a "sled" carrying these elements and others required to service the one or more printheads of the printer. This sled itself can be moved transversely to an axis of motion of the printhead carriage, for example in a vertical direction, so as to bring the caps or wipers into or out of contact with the printhead. Alternatively, a tumbler can be provided at the service station, and wipers, as well as caps, can be located on the tumbler. Rotation (and in some cases also vertical movement) of the tumbler effects wiping of the printhead, and/or alignment of one or more caps with one or more printheads positioned adjacent the tumbler at the service station.

To improve printing speed and the clarity and contrast of the printed image, recent advancements in the art have focused on improving the ink itself. For example, to provide faster, more waterfast printing with darker blacks and more vivid colors, improved pigment-based inks for inkjet applications have been developed. These pigment-based inks have a higher suspended solids content than earlier dye-based inks. Both types of ink dry quickly, which allows inkjet printing mechanisms to use plain paper. However, the combination of small nozzles and quick-drying ink leaves the printheads susceptible to clogging, in this case not only from the dried ink and minute dust particles or paper fibers, but also from the solids within the inks themselves. Further, this ink is more difficult to remove when dried than previously used dye-based inks. These characteristics compound the problems affecting print quality mentioned above.

Another characteristic of these pigment-based inks contributes to the nozzle clogging problem. The pigment-based inks use a dispersant to keep the pigment particles from flocculating. Unfortunately, the dispersant tends to form a tough film on the printhead orifice plate face. This dispersant film attracts and binds paper dust and other contaminants as well as solids from the ink itself. It has been recognized that this film, as well as ink residue and debris surrounding the printhead nozzles, is quite difficult to remove from the printhead.

It has been recognized that application of a servicing solvent will help mitigate the problem of dried ink by slowing the drying of ink or redissolving ink residue, rendering the printhead more easily cleanable by wiping. However problems associated with use of a servicing solvent have been identified.

Storage of the servicing solvent in adequate amounts for the life of the printer without leaking is problematic. For example leaks can occur caused by the tipping of the printer. Also, pressure differentials can occur because of a change in temperature or altitude during shipment. Also when treatment fluid is applied to a printhead, it is hard to avoid contaminating the source of servicing solvent by undesirable accumulations of ink solids, dispersants, and other debris. It is therefore desirable to maintain the means of applying servicing solvent and the servicing solvent itself in an uncontaminated state to provide consistent printhead cleaning over the life of the printer.

Also, it is important to meteri the amount of servicing solvent applied in wiping. Consistent optimal cleaning effectiveness as well as print quality can be compromised by application of too little or too much servicing solvent. Too little servicing solvent results in less effective residue removal allowing undesirable accumulation. Too much servicing solvent can result in one or more nozzles being at least temporarily disabled due to excess servicing solvent being pushed into the nozzle by the wiper, or drawn into the nozzle by negative pressure associated with operation.

With the constant need to apply and wipe off servicing solvent on the nozzle plate surface in order to keep it clean, the wetability of the surface is affected. This in turn affects the drop directionality of the ink as it is directed from the inkjet nozzles. The need exists for a way to stabilize the wetability of the nozzle plate surface so that the drop directionality of the ink directed from the inkjet nozzles can be stabilized to shoot consistently straight drops onto the print media.

With the existing technology, the nozzle plate has inconsistent wetting or surface energy during the life of the printhead. This causes the amount of ink left on the nozzle plate after wiping to change during the life of the print head.

The present inventors have found that adding a compatible surfactant to the servicing fluid controls the wetability of the nozzle plate during the life of the printhead.

SUMMARY OF THE INVENTION

The present invention relates to a system for servicing a portion of an inkjet printer having a printhead, comprising: a servicing fluid reservoir; a printhead wiper; means for releasing a predetermined amount of servicing fluid from said reservoirs onto said wiper; a wiper scraper; means for sequentially moving said wiper from a first location where said wiper engages said means for releasing to receive said predetermined amount of servicing fluid to a second location remote from said first location and said means for releasing, where said wiper engages said printhead to transfer said predetermined amount of said servicing fluid onto and wipe unwanted accumulations from said printhead, to a third location, remote from said printhead and from said first location, said wiper engaging said scraper at said third location to remove unwanted accumulations from said wiper; wherein the servicing fluid comprises a servicing solvent and a surfactant.

The invention further relates to a method of servicing a nozzle plate portion of a print head of an inkjet printer having a wiper to remove unwanted accumulations from the portion of the print head, comprising the steps of: providing a container of servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

The invention further relates to a method of using a compatible surfactant in a servicing fluid for servicing an orifice plate portion of a print head of an inkjet printer having a wiper to remove unwanted accumulations from the portion of the print head, comprising the steps of: providing a container of the servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

The invention also relates to a method of improving drop directionality of inkjet ink directed from an inkjet nozzle by using an alkyl amine oxide surfactant in conjunction with a servicing fluid for servicing a nozzle plate portion of a print head of an inkjet printer having a wiper to remove unwanted accumulations from the portion of the print head, comprising the steps of: providing a container of the servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

DETAILED DESCRIPTION OF THE INVENTION

The present invention addresses the need to stabilize the drop directionality of the ink directed from the inkjet nozzles. By adding a surfactant to the servicing solvent which is applied and wiped off of the nozzle plate surface in order to keep it clear of material buildup, the wetability of the surface is improved, which in turn improves consistency of ink puddling on the nozzle plate.

In one embodiment, the present invention relates to a system for servicing a portion of an inkjet printer having a print head, comprising: a servicing fluid reservoir; a printhead wiper; means for releasing a predetermined amount of servicing fluid from said reservoirs onto said wiper; a wiper scraper; means for sequentially moving said wiper from a first location where said wiper engages said means for releasing to receive said predetermined amount of servicing fluid to a second location remote from said first location and said means for releasing, where said wiper engages said printhead to transfer said predetermined amount of said servicing fluid onto and wipe unwanted accumulations from said printhead, to a third location, remote from said printhead and from said first location, said wiper engaging said scraper at said third location to remove unwanted accumulations from said wiper; wherein the servicing fluid comprises servicing solvent and a surfactant.

In another embodiment, the present invention relates to a method of servicing a nozzle plate portion of a print head of an inkjet printer having a wiper to remove unwanted accumulations from the portion of the print head, comprising the steps of: providing a container of servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

In yet another embodiment, the present invention relates to a method of using a compatible surfactant in a servicing fluid for servicing an orifice plate portion of a print head of an inkjet printer having a wiper to remove unwanted accumulations from the portion of the print head, comprising the steps of: providing a container of the servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

In yet another embodiment, the invention relates to a method of improving drop directionality of inkjet ink directed from an inkjet nozzle by using an alkyl amine oxide surfactant in conjunction with a servicing fluid for servicing a nozzle plate portion of a print head of an inkjet printer having a wiper to remove unwanted accumulations from the portion of the print head, comprising the steps of: providing a container of the servicing fluid; transferring said servicing fluid from said source onto at least one of two elements involved in print head servicing, said two elements consisting of said print head and said wiper; wiping said print head with said wiper by moving the wiper relative to the print head, said servicing fluid acting to enhance cleaning of the print head, wherein the servicing fluid comprises a servicing solvent and a surfactant.

In preferred embodiments of the above-described system and methods, the servicing solvent is selected from the group consisting of polyethylene glycol, polypropylene glycol, glycerol, ethoxylated glycerol, propoxylated glycerol, polypropylene glycol monobutyl ether and mixtures thereof. In a more preferred embodiment of the above-described system, the servicing solvent comprises polyethylene glycol having a molecular weight from 200 to 800. In another more preferred embodiment, the servicing solvent comprises polypropylene glycol having a molecular weight from 200 to 1000. In yet another more preferred embodiment, the servicing solvent comprises polypropylene glycol monobutyl ether having a molecular weight from 340 to 1000.

Non-limiting examples of commercially available surfactants which would be compatible in the present invention include polyethylene glycol which has from 200 to 800 molecular weight, PPG from 200 to 1000 mol. wt., glycerol, ethoxylated glycerol(such as LIPONIC EG-1(Glycereth-26) from Lipo Chemical Inc., Paterson, N.J., propoxylated glycerol, polypropylene glycol monobutyl ether having from 340 to 1000 mol wt.

In still another more preferred embodiment, the surfactant is soluble in the servicing fluid and is compatible with the inks. In another more preferred embodiment, the surfactants are selected from the group consisting of amine oxides and non-ionic surfactant. In yet another more preferred embodiment, the surfactant selected from the group consisting of non-ionic surfactant and amine oxide is present in the servicing solvent in an amount from 0 to 1.0 weight percent.

In still another more preferred embodiment, the amine oxide surfactant has the structure

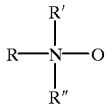

wherein R is selected from an alkyl group having from eight to eighteen carbons and an alkyl group having from eight to eighteen carbons with a O—$CH_2$—$CH_2$—$CH_2$— link to N; and R' and R" are selected from the group consisting of hydrogen; a methyl group; an oxy ethyl group; and an oxy propoxyl group. In an even more preferred embodiment, R has less than sixteen carbons.

A compatible surfactant is one that is soluble in the servicing fluid, soluble in the ink, and provides consistent wetting of the nozzle plate. Some surfactants will not be soluble in the servicing fluid or may cause separations or precipitation with the inks and this will cause nozzle clogging.

Non-limiting examples of compatible amine oxide and non-ionic surfactants are those having a long chain (R3) from 8 to eighteen carbons, with N-substituted R1 and R2 groups; R1 and R2 being equal or different substituents, and can include but not be limited to H, $CH_3$, ethers, ethoxylates, etc. Betaines and sulfobetaines are also compatible as are ethoxylated linear or branched nonionic surfactants. Non-limiting examples of commercial surfactants that work in this system are amine oxide surfactants such as the products made by Tomah Products, Inc. and AKZO. The non-ionic surfactants such as Tergitol® and Surfynol® also work in the servicing fluid. This work does not eliminate other types of surfactants that may also work for this application.

In general non-ionic, anionic, or amphoteric surfactants could be used in this invention. Most cationic surfactants will typically precipitate in normal inkjet inks. Anionic surfactants will typically not be soluble in the servicing solvents with the normal commercial cations. Amphoteric or nonionic surfactants are preferable because of their high surface activity that forces them to migrate to the nozzle plate surface and change, in a consistent manner, the wetability of the surface. The surface tension of the nozzle plate is thus reduced which promotes better firing directionality and improved print quality.

EXAMPLE

Example 1

Solubility of non-ionic surfactants in PEG300 and LEG-1

Non-ionic surfactants (Tergitol mini foam 1X, Tergitol 15-S-5, Surfynol465) and an anionic surfactant (Dodecylbenzene sulfonate Na) were tested for solubility in servicing fluids, including PEG300, LEG-1 at 0.1 wt. and 1.0 wt. concentration respectively. The pass/fail criteria were the absence or presence of insoluble material on the bottom of the container after three days at room temperature. The results are given in the table below. The dodecylbenzene sulfonate sodium salt was not soluble in the PEG300 or the LEG-1.

| Surfactant | Wt. % Conc. | Servicing Fluid | Solubility |
|---|---|---|---|
| Tergitol mini foam 1X | 0.1 | PEG300 | Pass |
| Tergitol mini foam 1X | 1.0 | PEG300 | Pass |
| Tergitol mini foam 1X | 0.1 | LEG-1 | Pass |
| Tergitol mini foam 1X | 1.0 | LEG-1 | Pass |
| Tergitol 15-S-5 | 0.1 | PEG300 | Pass |
| Tergitol 15-S-5 | 1.0 | PEG300 | Pass |
| Tergitol 15-S-5 | 0.1 | LEG-1 | Pass |
| Tergitol 15-S-5 | 1.0 | LEG-1 | Pass |
| Surfynol 465 | 0.1 | PEG300 | Pass |
| Surfynol 465 | 1.0 | PEG300 | Pass |
| Surfynol 465 | 0.1 | LEG-1 | Pass |
| Surfynol 465 | 1.0 | LEG-1 | Pass |
| Dodecylbenzene sulfonate Na | 0.1 | PEG300 | Fail |
| Dodecylbenzene sulfonate Na | 1.0 | PEG300 | Fail |
| Dodecylbenzene sulfonate Na | 0.1 | LEG-1 | Fail |
| Dodecylbenzene sulfonate Na | 1.0 | LEG-1 | Fail |

Example 2

Compatibility of Surfactants in the Test Ink

Non-ionic surfactants (Tergitol 15-S-5, Surfynol465), an amphoteric surfactant (Mackam OCT-50), an anionic surfactant (Dodecylbenzene sulfonate Na) and a cationic surfactant (Cetyl trimethyl ammonium bromide) were tested for solubility in an inkjet test ink having the following formulation.

Test Ink Formulation

~4 % dye
7.0% 2-pyrrolidone
9.6% 1,5 pentane diol
1.8% surfactants
0.5% kogation inhibitor
5.0% organic acid
72 % water The pass/fail criteria were the absence or presence of insoluble material on the bottom on the container after three days at room temperature. The results are given in the table below.

| Surfactant | Wt. % Conc. | Compat-ibility | Surfactant Type |
|---|---|---|---|
| Tergitol 15-S-5 | 1.0 | Pass | Non Ionic |
| Surfynol 465 | 1.0 | Pass | Non Ionic |
| Mackam OCT-50 | 1.0 | Pass | Amphoteric |
| Hexyl dimethyl amine oxide | 1.0 | Pass | special non ionic |
| Dodecylbenzene sulfonate sodium | 1.0 | Pass | Anionic |
| Cetyl trimethyl ammonium bromide | 1.0 | Fail | Cationic |

Example 3

Wetting Effectiveness of Surfactants on Orfice Plate

To determine an effective surfactant concentration range in a servicing fluid, the following procedure was used. A think uniform coat of test servicing fluid was applied to the nozzle plate. 0.5 $\mu$l of drop test ink was then applied to the coated nozzle plate and the maximum dot diameter was then measured.

The table below shows the wetting results of the various surfactants at several concentrations that were tested with PEG 300 Servicing Fluid. Wetting is considered "good" when a very thick layer of ink spreads out evenly on the orifice plate.

| Surfactant | Wt. % Concentration | Servicing Fluid | Wetting |
|---|---|---|---|
| Dimethyl Octylamine oxide | 0 | PEG 300 | Good |
| | 0.01 | PEG 300 | Good |
| | 0.1 | PEG 300 | Good |
| | 1.0 | PEG 300 | Poor |
| | 2.0 | PEG 300 | Poor |
| | 3.0 | PEG 300 | Poor |
| | 4.0 | PEG 300 | Poor |
| Admox 16 | 0.1 | PEG 300 | OK |
| | 1.0 | PEG 300 | Poor |
| Tomah AO405 | 0.1 | PEG 300 | Good |
| | 1.0 | PEG 300 | Poor |
| Tomah AO455 | 0.1 | PEG 300 | Good |
| | 1.0 | PEG 300 | Poor |
| Tomah E-14-5 | 0.1 | PEG 300 | OK |
| | 1.0 | PEG 300 | Poor |

This data suggest that concentration of surfactants higher than 0.1 weight % give poorer wetting. This data also indicate that R chains less than 16 carbons work better at higher concentrations.

Example 4

Testing of Servicing Solution on Orifice Plate 1 wt. % solutions of $C_8$AO (Hexyl dimethyl amine oxide), $C_{10}$AO (NN dimethyl octyl amine oxide), $C_{14}$AO (NN Dimethyl dodecyl amine oxide), $C_{18}$AO (Myristyl dimethyl amine oxide) and $C_{18}$AO (NN Dimethyl-N-oxide hexadecane amine) with PEG400 were prepared and placed in 50 ml tubes. The tubes were observed daily for seven days. No separation of surfactant from PEG400 was observed.

These PEG solutions were then tested in a strobe vision system with Magenta inkjet ink. This test involved looking at the surface puddling of ink on the orifice plate under various firing frequencies.

This testing indicated that the low chain length Amine oxide/PEG solutions improved the performance of the print head by giving a very thin, consistent layer of ink for the drop to fire through.

Amounts are given in the table below.

| | Tare | Amine Oxide | PEG | Wt % |
|---|---|---|---|---|
| Dimethyl hexyl amine oxide | 48.49 | 0.07014 | 10.01 | 0.7007 |
| NN Dimethyl octyl amine oxide | 48.47 | 0.11 | 10.04 | 1.0956 |
| NN Dimethyl dodecyl amine oxide | 48.18 | 0.102 | 10.06 | 1.0139 |
| Myristyl Dimethyl amine oxide | 48.83 | 0.11 | 10 | 1.1 |
| NN Dimethyl-N-oxide hexadecane amine | 48.42 | 0.12 | 12 | 1 |

What is claimed is:

1. A method of servicing a nozzle plate portion of a print head of an inkjet printer having a wiper to remove unwanted accumulations from the nozzle plate portion of the print head, comprising the steps of:

providing a container of servicing fluid;

transferring said servicing fluid from said container onto at least one of two elements involved in print head servicing, said two elements consisting of said print head and said wiper, wiping said print head with said wiper by moving the wiper relative to the print head, said servicing fluid acting to enhance cleaning of the print head, wherein the servicing fluid comprises a servicing solvent and a surfactant, the surfactant being amine oxide surfactants having a structure

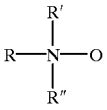

wherein R is selected from an alkyl group having from eight to eighteen carbons and an alkyl group having from eight to eighteen carbons with a O—CH2—$CH_2$—$CH_2$— link to N; and R' and R" are selected from the group consisting of hydrogen; a methyl group; an oxy ethyl group; and an oxy propoxyl group.

2. The method according to claim 1, wherein R has less than sixteen carbons.

3. A method of using a compatible surfactant in a servicing fluid for servicing an orifice plate portion of a print head of an inkjet printer having a wiper to remove unwanted accumulations from the orifice plate portion of the print head, comprising the steps of: providing a container of the servicing fluid;

transferring said servicing fluid from said source onto at least one of two elements involved in print head servicing, said two elements consisting of said print head and said wiper;

wiping said print head with said wiper by moving the wiper relative to the print head, said servicing fluid acting to enhance cleaning of the print head, wherein the servicing fluid comprises a servicing solvent and a surfactant, the surfactant being amine oxide surfactants having a structure

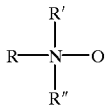

wherein R is selected from an alkyl group having from eight to eighteen carbons and an alkyl group having from eight to eighteen carbons with a O—$CH_2$—$CH_2$—$CH_2$— link to N; and R' and R" are selected from the group consisting of hydrogen; a methyl group; an oxy ethyl group; and an oxy propoxyl group.

4. The method according to claim 3, wherein R has less than sixteen carbons.

5. A method of improving drop directionality of inkjet ink directed from an inkjet nozzle by using an alkyl amine oxide surfactant in conjunction with a servicing fluid for servicing a nozzle plate portion of a print head of an inkjet printer having a wiper to remove unwanted accumulations from the nozzle plate portion of the print head, comprising the steps of:

providing a container of the servicing fluid;

transferring said servicing fluid from said container onto at least one of two elements involved in print head servicing, said two elements consisting of said print head and said wiper;

wiping said print head with said wiper by moving the wiper relative to the print head, said servicing fluid acting to enhance cleaning of the print head, wherein the servicing fluid comprises a servicing solvent and a surfactant the surfactant being amine oxide surfactants having a structure

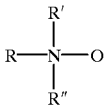

wherein R is selected from an alkyl group having from eight to eighteen carbons and an alkyl group having from eight to eighteen carbons with a O—$OH_2$—$CH_2$—$CH_2$— link to N; and R' and R" are selected from the group consisting of hydrogen; a methyl group; an oxy ethyl group, and an oxy propoxyl group.

6. The method according to claim 5, wherein R has less than sixteen carbons.

* * * * *